United States Patent [19]

Piasecki

[11] 4,429,939

[45] Feb. 7, 1984

[54] ELECTRICAL CABLE ASSEMBLY

[75] Inventor: Raymond F. Piasecki, Leonardo, N.J.

[73] Assignee: Thomas & Betts Corporation, Raritan, N.J.

[21] Appl. No.: 300,466

[22] Filed: Sep. 9, 1981

[51] Int. Cl.[3] ..... H01R 11/20

[52] U.S. Cl. ..... 339/97 C

[58] Field of Search ..... 339/97 C, 97 R, 97 P, 339/98, 99 R

[56] References Cited

U.S. PATENT DOCUMENTS

| | | | |
|---|---|---|---|
| 3,462,542 | 8/1969 | Richter | 174/88 |
| 3,544,192 | 12/1970 | Goldstein | 350/96 |
| 3,960,430 | 6/1976 | Bunnell et al. | 339/97 C |
| 4,065,199 | 12/1977 | Andre et al. | 339/17 |
| 4,219,928 | 9/1980 | Kuo | 29/868 |
| 4,249,304 | 2/1981 | Weinmann et al. | 29/872 |
| 4,283,593 | 8/1981 | Piasecki et al. | 174/36 |
| 4,315,662 | 2/1982 | Greenwood et al. | 339/97 C |

*Primary Examiner*—Joseph H. McGlynn

*Attorney, Agent, or Firm*—Robert M. Rodrick; Salvatore J. Abbruzzese

[57] ABSTRACT

A flat multiconductor cable assembly for use in under-carpet wiring systems for ring-main installations has interconnections selectively made among cable conductors such that a continuous two-wire loop is provided which is accessible through commonly disposed ends of the conductors. System wiring employs such internal loop flat cable for connection to power mains and employs secondary flat cables for connection between the internal loop cable and outlet receptacles.

24 Claims, 6 Drawing Figures

ELECTRICAL CABLE ASSEMBLY

FIELD OF THE INVENTION

This invention relates to electrical wiring systems and pertains more particularly to electrical cable assemblies and systems for use in electrical wiring under United Kingdom and other ring-main wiring practice.

BACKGROUND OF THE INVENTION

In U.S. Pat. Nos. 4,219,928 and 4,249,304, and corresponding British Pat. Nos. 2,052,134 published on Apr. 20, 1983 and 2,050,208 published on July 20, 1983, an electrical cable assembly and system are shown for installation beneath an overlying carpeting material in offices and like areas.

The cable assembly includes an elongate flat cable having flat electrical conductors encased in electrical insulation, with a protective overlayer, in the form of a metallic shield displaceable from the cable for connection purposes, and a protective underlayer to permit laying of the cable assembly directly upon unfinished surfaces, such as concrete floors.

Typically, for single phase installation, the primary or feed cable has three conductors, termed line, neutral or return and grounding conductors. This cable is connected to power mains and extends radially, i.e., lengthwise, into the office. Secondary flat multiconductor cables are placed in overlying relation to the feed cable and led therefrom transversely to locations at which outlets are desired for powering of lights, typewriters, computer terminals, etc. At its end distal from the feed cable, each secondary cable is connected to a wall outlet or the like.

At the location of registry of the secondary and primary cables, individual conductors of the secondary cable are connected, as by insulation-piercing connectors, to corresponding conductors of the primary cable. Such "tap" connections are made with the shields displaced from the cables and the connections are suitably electrically insulated from the ground shield prior to replacement of the shields in overlying disposition to the connected cables. Each shield is secured to its cable by electrical and mechanical connection to the cable grounding conductor, e.g., the shield is welded to the grounding conductor at locations spaced along the length of the cable. This feature not only permits one to cut the shield for tap or splice connections to the cable at virtually any location, but insures that such interruption of integrity of the shield by cutting will not give rise to a discontinuity in the protective electrical connection of the shields to electrical ground.

While deployment of the foregoing wiring system as a direct substitute for wiring systems of traditional character disposed in costly raceways, ductwork and the like in the United States was in initial design requirement, implementation of the system in ring-main practice, such as in Great Britain, was not an original design parameter. A basic disparity, existing as between United States and British wiring practices, precludes direct use in Great Britain of the three-conductor system above described. Thus, in British ring-main practice commencing in the early nineteen fifties, one forms a loop fully about the room being wired, three conductors (line, neutral and earth) encircling the room. The opposite ends of the individual conductors are connected to one another at a feed location and then connected to the power mains. The conductors are led within so-called skirting at baseboard level and over plinths into architraves and therethrough in traversing doorways. Connections are made in parallel circuit from the baseboard skirting to wall receptacles through secondary skirting. Receptacles are distributed spacedly circumferentially of the loop and, under British practice, may be introduced at will since plugs are individually electrically fused in accordance with the load they present to the system.

Although the British baseboard and architrave skirting arrangements track the traditional American ducting and raceway needs as respects complexity of wiring system installations heretofore available and difficulty of later modification, British technology in this area would not appear to be enhanced by the introduction of undercarpet wiring in the form above discussed. While one concievably could take the three-conductor flat cable and loop the same about the room, the comparative installation cost would not be as much reduced by such practice versus ring-main British practice as is the undercarpet wiring system installation cost reduced versus traditional practice in the United States. In this possible British approach, installation would be cost-burdened by the cable assembly material required to add three legs, namely, two cross legs and the return leg of cable and shield, to transform the single feed cable running radially in one direction into a full loop.

SUMMARY OF THE INVENTION

It is an object of the present invention to provide for the efficient installation of flat multiconductor wiring systems in accordance with British ring-main wiring practice.

It is a more particular object of the invention to provide loop-type undercarpet wiring systems.

In attaining the foregoing and other objects, the invention introduces a ring-main circuit loop within a flat multiconductor cable assembly. The invention provides an electrical cable assembly comprising a flat multiconductor cable arranged such that a first course thereof overlies a further course of the cable, whereby the cable conductors are in mutually overlapping relation. Electrical connections are made between conductors in selective areas of such overlapping registry.

In a particular embodiment for meeting British practice, the cable assembly includes five conductors and extends, as in the case of the United States practice above discussed, with overlying shield member longitudinally from a feed location, to which first end terminals of the cable are connected. At the opposite longitudinal end of the cable, the shield is lifted from its overlying disposition to the cable, and the cable is end-folded upon itself at about forty-five degrees, such that the end of the cable is disposed in line registry with a side margin of the cable. At the location of registration of the outwardmost conductors, an insulation-piercing connector electrically interconnects these conductors. Likewise, at the location of registration of the conductors immediately aside the central (earth) conductor, these conductors are joined electrically. A full loop is thus provided within a flat multiconductor cable. The connections are electrically insulated preparatory to the return of the shield to overlying disposition to the loop cable.

In the wiring system of the invention, tap connections are made sidewise of the cable assembly between receptable locations on such side and the three successive conductors on such side, providing further implementation of the British practice in a multiconductor flat cable environment.

The foregoing and other features of the invention will be further evident from the following description of preferred embodiments and practices and from the drawings wherein like reference numerals identify like parts throughout.

DESCRIPTION OF THE PREFERRED EMBODIMENTS AND PRACTICES

Figure 1:
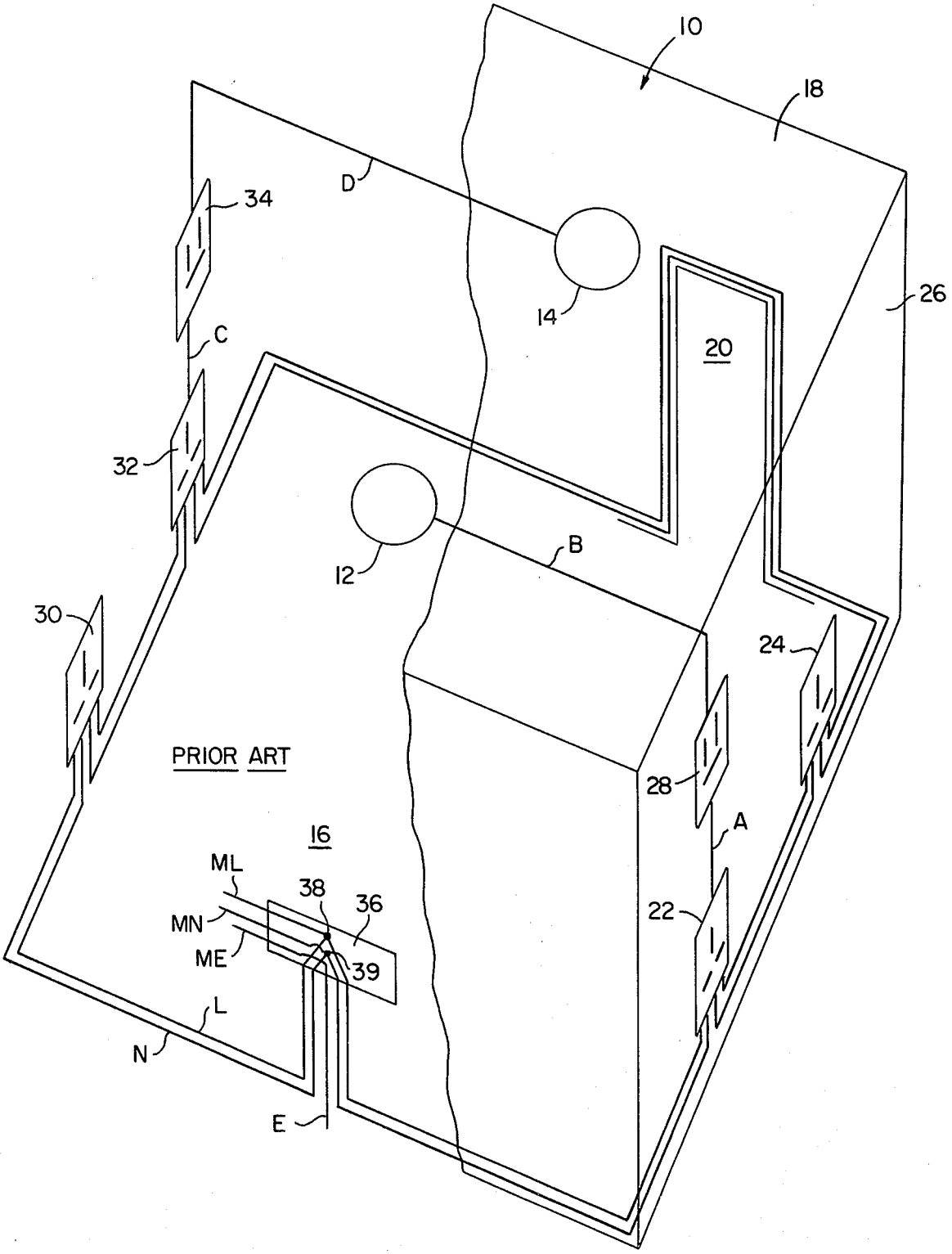
FIG. 1 is a schematic illustration in perspective of a typical room electrical wiring system in Great Britain.

By way of introduction to the invention, discussion will be had initially of a ring-main wired British office facility. In FIG. 1, office 10 has ceiling lights 12 and 14, floor 16, and front wall 18 with entrance 20 formed therein. Outlet receptacles 22 and 24 are situated in side wall 26, lighting switch 28 providing control of light 12. An opposite wall has receptacles 30 and 32 therein and lighting switch 34 for control of light 14.

Consumer supply or feed unit 36 is connected to building mains ML, MN and ME and services the office with power. A loop arrangement has conductors L and N with first ends connected to ML and MN and thence extending upon wall surface clockwise about the office beneath appropriate skirting (not shown). As the loop reaches the entrance, suitable plinth and architrave are provided to permit the conductors to travel upwardly, across the entrance and downwardly to again travel in the baseboard skirting to return to feed unit 36, wherein the returning ends of conductors L and N are connected at 38 and 39, respectively to previously-mentioned other ends thereof. The receptacles are connected in parallel circuit manner to conductors M and L. For convenience, the earth loop conductor E is not shown as being furnished to the receptacles. Further conductors A,B,C, and D extend between the receptacles and light switches and between light switches and ceiling lights.

Figure 2:
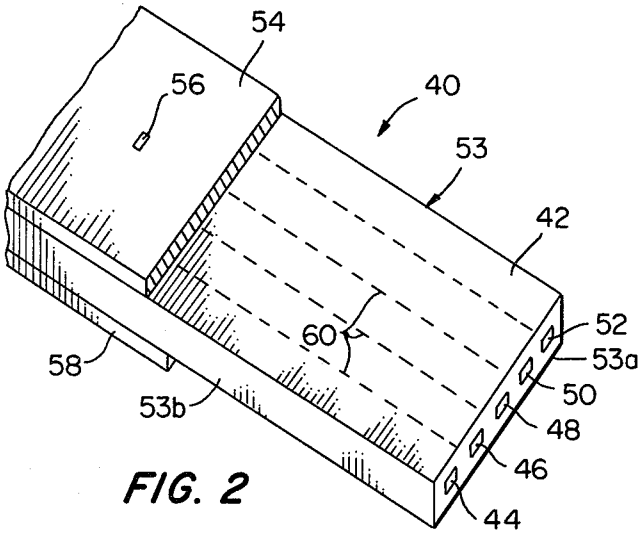
FIG. 2 is a perspective illustration of a cable assembly presently employed in undercarpet wiring systems in the United States.

In otherwise wiring the office of FIG. 1, i.e., in flat multiconductor undercarpet manner in accordance with the invention, use is made of cable assembly 40, shown in FIG. 2. Cable electrical insulation 42 circumscribingly encases five electrical conductors 44,46,48,50 and 52. A top protective member 54 of the cable assembly is preferably comprised of metal, such as a copper sheet, and is mechanically and electrically connected to cable 53 by weldments 56 providing electrical continuity between member 54 and cable earth conductor 48, such that member 54 constitutes an electrical shield. An additional protective layer (not shown), such as a steel sheet may be placed over the upper protective members. While but one such weldment is shown in FIG. 2, plural weldments are provided, being at locations mutually spaced longitudinally along the elongate cable assembly. Member 54 thus has successive extends which are respectively secured and unsecured to cable 53. By cutting across member 54 and lifting it from the cable, one gains access to the cable for connections thereto, as discussed below, without the loss of electrical continuity between member 54 and earth. A protective underlayer 58, typically of a suitable electrically insulative material, permits installation of the cable assembly directly upon concrete floors. To facilitate connection of the conductor ends within feed unit 36, cable 53 includes surface slits 60, whereby individual conductors with insulation may be separated and spread from one another.

Figure 3:
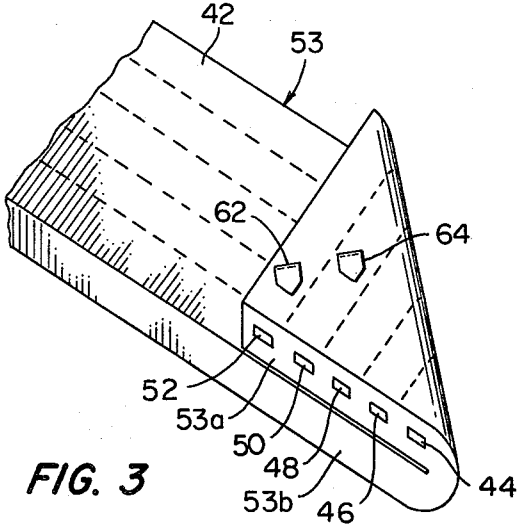
FIG. 3 is a partial perspective view of the FIG. 2 cable assembly adapted for use in accordance with the invention for implementing undercarpet wiring systems in Great Britain.

Cable 53 is shown in FIG. 3 without its protective layers 54 and 58 for convenience of illustration. An end course of the cable is folded upon itself, such that the end face **53*a* is in registry with side margin 53*b* and the conductors traverse in overlying disposition a contiguous course or run of the cable, thereby traversing other conductors, placing the cable conductors in mutually overlapping relation. Electrical connectors 62 and 64 selectively interconnect conductors, as will be seen by reference to the enlarged partial view of the FIG. 3 arrangement shown in FIG. 4**.

Figure 4:
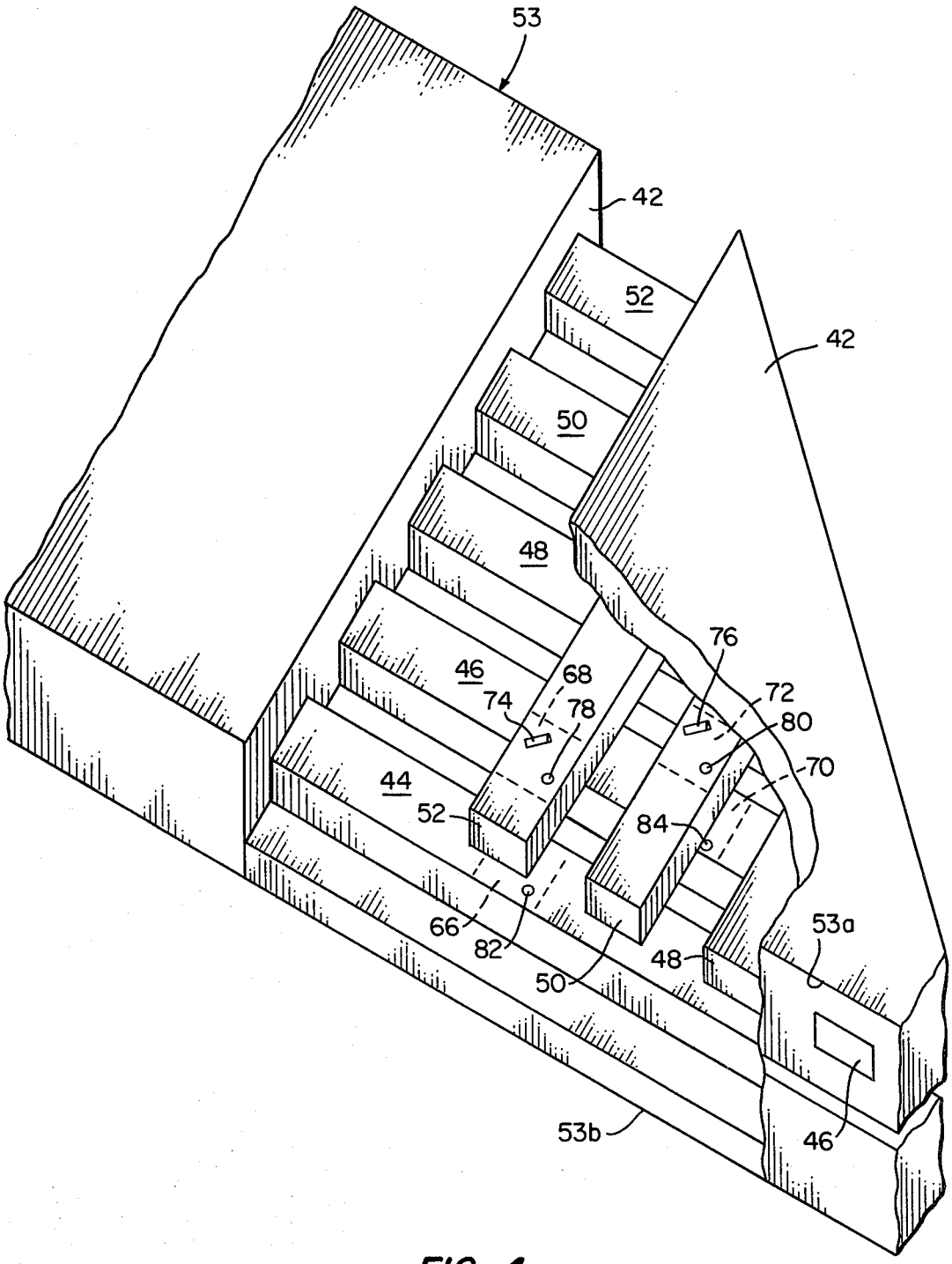
FIG. 4 is an enlarged partial perspective view of the FIG. 3 cable assembly arrangement partly broken away to reveal internal details and with various structure omitted in the interests of clarity of presentation.

Insulative casing 42 of cable assembly 40 is broken away in FIG. 4 to reveal the dispositions of conductors 44 and 46 beneath the traversing conductors 48, 50 and 52 and the zones of connection registry thereof. As is indicated by broken lines, zones 66 and 68 of conductors 44 and 52 are available for interconnection purposes as are zones 70 and 72 of conductors 46 and 50. Larger openings are formed through cable 53 in these zones, two such larger openings being shown at 74 and 76. Smaller openings are also formed through the cable, as are shown at 78, 80, 82 and 84. The openings of both sizes extend through the entirety of cable insulation 42 in registry therewith, for purposes discussed now in connection with the preferred connector shown in FIG. 5.

Figure 5:
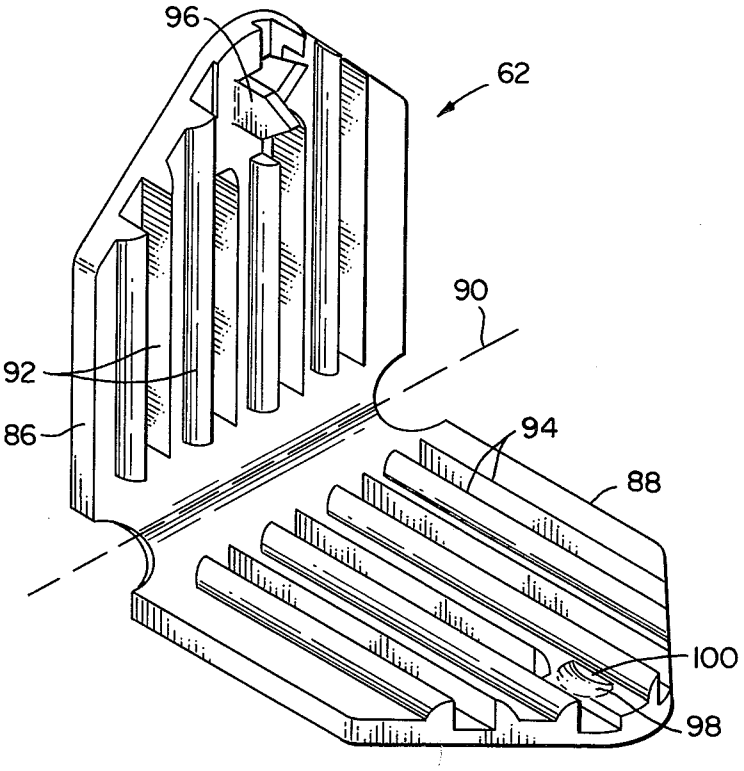
FIG. 5 is a perspective illustration of an electrical connector for use in the FIG. 3 cable assembly arrangement.

Connector 62 of FIG. 5 is formed with first and second arm portions 86 and 88, mutually hinged for movement about axis 90. Insulation-piercing contact teeth 92 and 94 are provided on the respective facing surfaces of arms 86 and 88 in mutually staggered relation along axis 90, as is more fully discussed in U.S. patent application, Ser. No. 123,489 filed on Feb. 21, 1980 and in corresponding British patent application No. 8,105,376, filed on Feb. 20, 1981 and commonly assigned herewith. The connector is sized so as to be insertable into a larger opening formed in cable 53, e.g., opening 76 of FIG. 4, and then be arranged, such as by crimping, with arms 86 and 88 in facing relation to opposite sides of insulative casing 42. A tab 96 extends outwardly of arm 86 to register with a smaller opening, e.g., opening 80 of FIG. 4. Upon crimping of the connector so arranged upon the cable, the insulation piercing teeth are placed in electrical engagement with the conductors confronted thereby and tab 96 enters hood 98 of arm 88 to be deflected by inner surface of the hood sidewardly into and through hood opening 100 to latch the connector in place.

Figure 6:
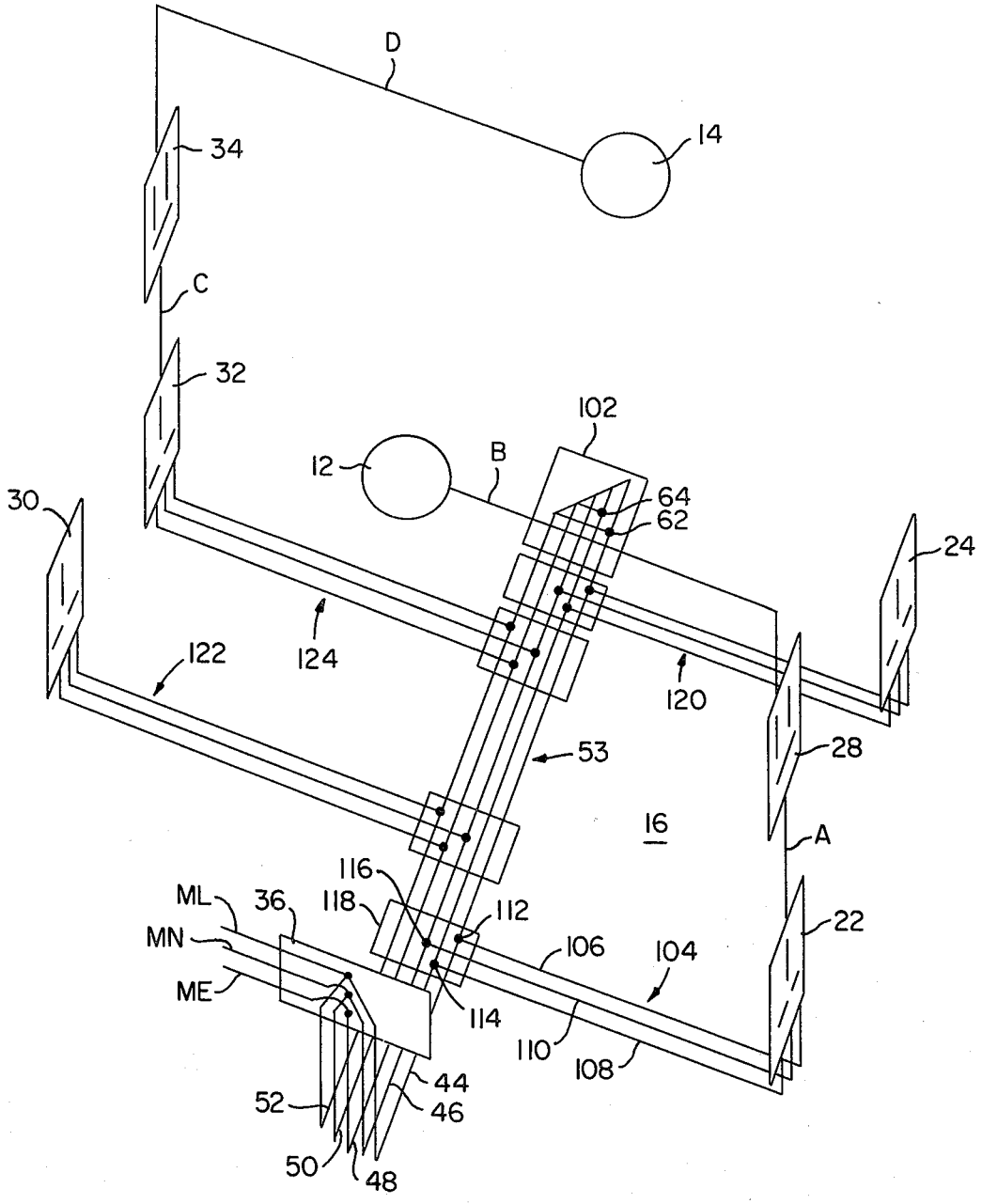
FIG. 6 is schematic illustration of a room wiring system in accordance with the invention.

Turning now to FIG. 6, the office of FIG. 1 is shown again, however, here wired with the loop configuration flat multiconductor cable of FIGS. 3 and 4. Connection is made of first ends of conductors 44 and 52 and first ends of conductors 46 and 50 in consumer unit 36. Cable 53 is dressed upon floor 16 to extend lengthwise centrally of the room. At second ends of conductors 44 and 52, interconnection thereof is made through connector 62. Connector 64 likewise connects second ends of conductors 46 and 50. An insulator 102 is placed over the folded end of the cable. The shield member, not shown in the schematic version of FIG. 6, would be placed in protective overlying relation to insulator 102. Secondary flat three-conductor cable 104 is placed in tap fashion upon cable 53, the shield member overlying the cable having been cut and lifted from the cable. Connections are made between secondary cable conductors 106,108 and 110 and feed cable conductors 44,46 and 48, respectively, by connectors 112,114 and 116. Insulator 118 is placed atop the tap thus made and the shield member is again returned to overlying relation to cable 53. Opposite ends of conductors 106,108 and 110 are connected to the terminals of receptacle 22. Like secondary cable connections are made as between cable 53 and receptacle 24 through cable 120, as between cable 53 and receptacle 30 through cable 122 and as between cable 53 and receptacle 32 through cable 124.

Each of the secondary cables is provided with an overlying electrically conductive member which is connected to the earth conductor of the secondary cable, e.g., conductor 110 of secondary cable 104. Electrical continuity is thus provided for the secondary cable overlying members to earth, based on connection of conductor 110 to primary cable earth conductor 48.

In its several aspects, the invention will be seen to provide both components and system for electrical wiring. In one aspect, the invention defines a two wire loop circuit in a multiconductor flat cable such that commonly disposed cable conductor ends define respective pairs of input and output terminals of the loop circuit. As the conductors are disposed in a common plane, i.e., a common plane intersects all conductors, and are encased in a common electrically insulative body of flat configuration, the loop circuit may be situate beneath carpet tiles or the like and be virtually undetectable from an aesthetic viewpoint. In another aspect, being the foregoing particularly depicted preferred embodiment of the cable assembly of the invention, the loop circuit is formed by folding the cable upon itself at an end thereof and connection is made between overlapping conductors. Other embodiments are of course within the contemplation of the invention, such as the providing of conductor interconnection at other than an end cable location, the connection of conductors to one another without need for folding, as by contacts which would suitably bridge the conductors in common plane, etc. In a further aspect, the invention provides the wiring system at large, wherein a feed flat cable and a secondary flat cable are interconnected, the primary feed cable defining the requisite loop for ring-main practice.

Given the modifications above and others which will be evident to those skilled in the art, the particularly described embodiments are intended in an illustrative and not in a limiting sense. The true spirit and scope of the invention is set forth in the following claims.

What is claimed is:

1. An electrical cable assembly comprising an elongate flat cable having a plurality of electrical conductors and electrical insulation about said conductors, first and second courses of said cable situated in mutually overlapping relation defining zones of interconnection registry for said conductors, and electrical connector means interconnecting together selected different ones of such conductors at said registry zones.

2. The cable assembly claimed in claim 1 wherein said electrical connector means comprises insulation-piercing contact means.

3. The cable assembly claimed in claim 1 wherein said first cable course is an end course of said cable.

4. The cable assembly claimed in claim 3 wherein said second cable course is contiguous with said first end course.

5. The cable assembly claimed in claim 3 wherein the end face of said first cable course is in linewise registry with a side margin of said cable.

6. The cable assembly claimed in claim 1 further including an electrically conductive member displaceably overlying said cable.

7. The cable assembly claimed in claim 6 wherein said conductive member is mechanically and electrically connected to said cable.

8. The cable assembly claimed in claim 7 wherein at least one of said conductors is not interconnected to any others of said conductors and wherein said conductive member is electrically connected to said one conductor.

9. The cable assembly claimed in claim 1 wherein at least four said conductors are included, said electrical connector means comprising a first connector interconnecting one pair of said conductors and a second connector interconnecting the other pair of said conductors.

10. The cable assembly claimed in claim 9 wherein said first and second connectors are of insulation-piercing contact type.

11. An electrical cable assembly comprising a plurality of elongate electrical conductors disposed in a common plane and encased in a common electrically insulative body of flat configuration, commonly disposed ends of different ones of said conductors being interconnected and defining respective pairs of input and output terminals of an electrically continuous two-wire loop circuit provided therebetween by said conductors.

12. The cable assembly claimed in claim 11 wherein said conductors are selectively interconnected at ends thereof opposite said commonly disposed ends.

13. An electrical wiring system for connection to line and neutral power mains comprising:

(a) a first flat multiconductor cable having different conductors thereof selectively interconnected to one another at a preselected location along said cable and connected to said line and neutral power mains at an end of said cable;

(b) a second flat multiconductor cable disposed in overlying relation to said first cable between said location and said cable end and having conductors thereof connected to conductors of said first cable at the position of said overlying relation, said second cable extending transversely from said first cable.

14. The electrical wiring system claimed in claim 13 wherein said first cable includes first and second courses situated in mutually overlapping relation to define said preselected location and provide zones of interconnection registry for said first cable conductors, and electrical connector means for interconnecting selected of such conductors at said registry zones.

15. The wiring system claimed in claim 14 wherein said electrical connector means comprises insulation-piercing contact means.

16. The wiring system claimed in claim 14 wherein said first cable course is an end course of said first cable.

17. The wiring system claimed in claim 16 wherein said second cable course of said first cable is contiguous with said first end course thereof.

18. The wiring system claimed in claim 16 wherein the end face of said first cable course is in linewise registry with a side margin of said first cable.

19. The wiring system claimed in claim 14 further including first and second electrically conductive members respectively displaceably overlying said first and second cables.

20. The wiring system claimed in claim 19 wherein each said conductive member is mechanically and electrically connected to its underlying cable.

21. The wiring system claimed in claim 20 wherein at least one of said conductors of said first cable is not interconnected to any others of said conductors of said first cable and wherein said conductive member overlying said first cable is electrically connected to said one conductor.

22. The wiring system claimed in claim 21 wherein one of said conductors of said second cable is electrically connected both to said one conductor of said first cable and to said conductive member overlying said second cable.

23. The wiring system claimed in claim 14 wherein at least four said conductors are included in said first cable, and electrical connector means comprising a first connector interconnecting one pair of said four conductors and a second connector interconnecting the other pair of said four conductors.

24. The wiring system claimed in claim 23 wherein said first and second connectors are of insulation-piercing contact type.

* * * * *